US012085369B2

(12) United States Patent
Miller

(10) Patent No.: US 12,085,369 B2
(45) **Date of Patent: *Sep. 10, 2024**

(54) BALLISTIC-RESISTANT GARMENT

(71) Applicant: Angel Armor, LLC, Fort Collins, CO (US)

(72) Inventor: Ryan M. Miller, Wellington, CO (US)

(73) Assignee: Angel Armor, LLC, Fort Collins, CO (US)

( * ) Notice: Subject to any disclaimer, the term of this patent is extended or adjusted under 35 U.S.C. 154(b) by 75 days.

This patent is subject to a terminal disclaimer.

(21) Appl. No.: 17/877,178

(22) Filed: Jul. 29, 2022

(65) Prior Publication Data

US 2023/0142484 A1 May 11, 2023

Related U.S. Application Data

(60) Provisional application No. 63/229,421, filed on Aug. 4, 2021, provisional application No. 63/228,558, filed on Aug. 2, 2021.

(51) Int. Cl.
*F41H 5/013* (2006.01)
*A41D 1/04* (2006.01)
(Continued)

(52) U.S. Cl.
CPC ..... *F41H 5/013* (2013.01); *A41D 1/04* (2013.01); *A41D 13/0518* (2013.01);
(Continued)

(58) Field of Classification Search
CPC ..... F41H 5/013; A41D 31/24; A41D 1/04; A41D 13/0518; A41D 2400/48; A41D 27/12; A45F 3/047
See application file for complete search history.

(56) References Cited

U.S. PATENT DOCUMENTS 3,557,384 A * 1/1971 Barron ..... F41H 1/02 2/2.5
10,060,707 B2 * 8/2018 Searle ..... A41D 1/04
(Continued)

OTHER PUBLICATIONS

Point Blank Body Armor. IQ3 Sales Sheet. Website, https://www.pointblankenterprises.com, originally downloaded Aug. 30, 2023, 1 page.

*Primary Examiner* — Heather Mangine
*Assistant Examiner* — Erick I Lopez
(74) *Attorney, Agent, or Firm* — Craig R. Miles; CR MILES P.C.

(57) ABSTRACT

A ballistic-resistant garment having a tensioning fastening system, and methods of making and using such a ballistic-resistant garment, whereby the ballistic-resistant garment includes (i) a front panel having a front panel pocket configured to receive a first ballistic-resistant insert; (ii) a back panel having a back panel pocket configured to receive a second ballistic-resistant insert; (iii) a front panel elastic elongate member coupled to the front panel; (iv) a front panel first fastener coupled to a front panel elastic elongate member first end; (v) a front panel second fastener coupled to a front panel elastic elongate member second end; (vi) a back panel elastic elongate member coupled to the back panel; (vii) a back panel first fastener coupled to a back panel elastic elongate member first end; and (viii) a back panel second fastener coupled to a back panel elastic elongate member second end.

18 Claims, 14 Drawing Sheets

(51) Int. Cl.
*A41D 13/05* (2006.01)
*A41D 31/24* (2019.01)

(52) U.S. Cl.
CPC ..... *A41D 13/0568* (2013.01); *A41D 13/0575* (2013.01); *A41D 31/24* (2019.02); *A41D 2300/332* (2013.01); *A41D 2400/48* (2013.01)

(56) References Cited

U.S. PATENT DOCUMENTS

| | | | | |
|---|---|---|---|---|
| 2014/0332572 | A1* | 11/2014 | Buerck | A41F 1/00 24/351 |
| 2017/0160058 | A1* | 6/2017 | Limpisvasti | F41H 1/02 |
| 2017/0205205 | A1* | 7/2017 | Wellman | A41D 13/0568 |

* cited by examiner

BALLISTIC-RESISTANT GARMENT

I. SUMMARY OF THE INVENTION

A broad object of a particular embodiment of the invention can be to provide a ballistic-resistant garment having a tensioning fastening system, and methods of making and using such a ballistic-resistant garment, whereby the ballistic-resistant garment includes (i) a front panel having a front panel pocket configured to receive a first ballistic-resistant insert; (ii) a back panel having a back panel pocket configured to receive a second ballistic-resistant insert; (iii) a front panel elongate member coupled to the front panel, the front panel elongate member having an elastic length disposed between opposing first and second ends; (iv) a front panel first fastener coupled to the front panel elongate member first end; (v) a front panel second fastener coupled to the front panel elongate member second end; (vi) a back panel elongate member coupled to the back panel, the back panel elongate member having an elastic length disposed between opposing first and second ends; (vii) a back panel first fastener coupled to the back panel elongate member first end; and (viii) a back panel second fastener coupled to the back panel elongate member second end. The front panel first fastener can matably engage with the back panel first fastener to provide a first pair of releasably engaged fasteners, and the front panel second fastener can matably engage with the back panel second fastener to provide a second pair of releasably engaged fasteners; whereby the first and second pair of releasably engaged fasteners couple the front and back panels to tensionably fasten the ballistic-resistant garment about the torso of a wearer.

Naturally, further objects of the invention are disclosed throughout other areas of the specification, drawings, and claims.

II. BRIEF DESCRIPTION OF THE DRAWINGS

III. DETAILED DESCRIPTION OF THE INVENTION

Figure 5B:
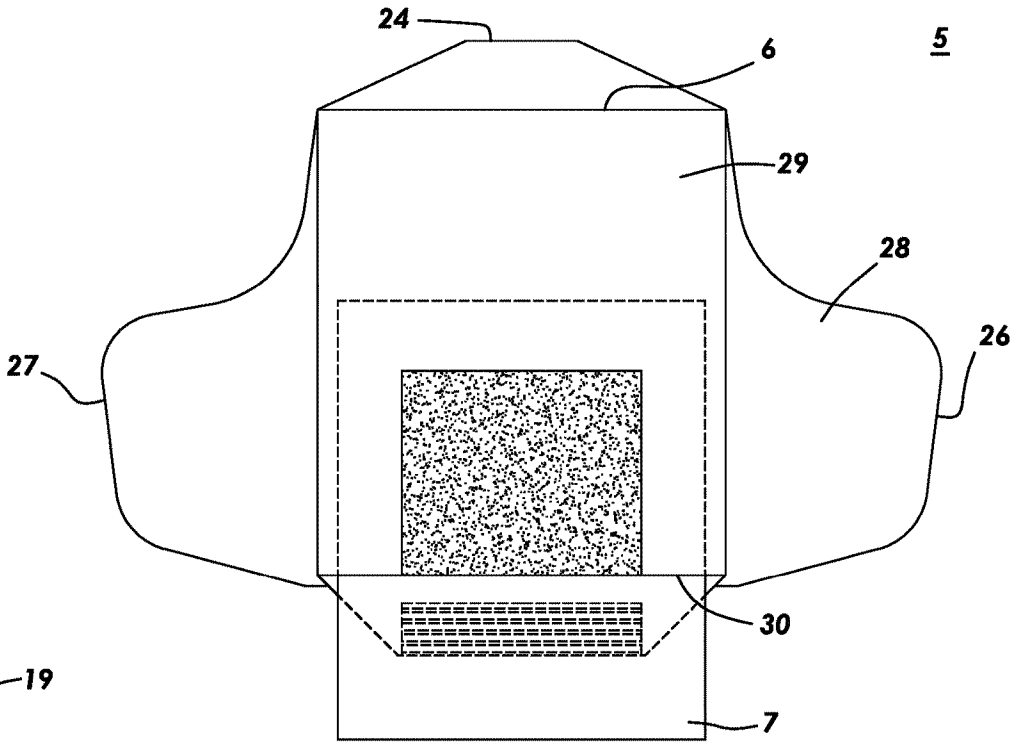
FIG. 5B is an inner view of a particular embodiment of a back panel of the inventive ballistic-resistant garment, whereby a second ballistic-resistant insert is partially received within a back panel pocket.

Now referring primarily to FIGS. 1A through 2B, and 4A through 5B, which illustrate a particular embodiment of the inventive ballistic-resistant garment (1) having a tensioning fastening system, such as a tensioning fastening system which can provide 360° of tension for a customized fit. A wearer can wear the ballistic-resistant garment (1) about their torso to protect said torso from ballistic threats, whereby the ballistic-resistant garment (1) includes a front panel (2) having a front panel pocket (3) configured to receive a first ballistic-resistant insert (4) (as shown in the example of FIG. 5A), and a back panel (5) having a back panel pocket (6) configured to receive a second ballistic-resistant insert (7) (as shown in the example of FIG. 5B). The ballistic-resistant garment (1) further includes a front panel elongate member (8) coupled to the front panel (2), a front panel first fastener (9) coupled to a front panel elongate member first end (10), a front panel second fastener (11) coupled to a front panel elongate member second end (12), a back panel elongate member (13) coupled to the back panel (5), a back panel first fastener (14) coupled to a back panel elongate member first end (15), and a back panel second fastener (16) coupled to a back panel elongate member second end (17).

The front panel first fastener (9) can be configured to matably engage with the back panel first fastener (14) to provide a first pair of releasably engaged fasteners (18), and the front panel second fastener (11) can be configured to matably engage with the back panel second fastener (16) to provide a second pair of releasably engaged fasteners (19), whereby the first and second pair of releasably engaged fasteners (18)(19) can couple the front and back panels (2)(5) to tensionably fasten the ballistic-resistant garment (1) about the torso of a wearer.

The term "torso" for the purposes of this invention means the trunk of a human body, the trunk excluding the head, neck, and limbs. The torso can be divided into a front torso and a back torso, the front torso encompassing the anterior portion of the trunk of the human body, including the chest and the abdomen, the back torso encompassing the posterior portion of the trunk of the human body, including the back.

The term "front" for the purposes of this invention relates to an anterior portion. Correspondingly, the front panel (2) of the ballistic-resistant garment (1) means the portion of the ballistic-resistant garment (1) configured to be worn about the anterior portion of the human body.

The term "back" for the purposes of this invention relates to a posterior portion. Correspondingly, the back panel (5) of the ballistic-resistant garment (1) means the portion of the ballistic-resistant garment (1) configured to be worn about the posterior portion of the human body.

The term "left" for the purposes of this invention means a left portion of a subject, such as a wearer, or a portion of a component of the ballistic-resistant garment (1) which would dispose proximate the left portion of the wearer when said wearer wears the ballistic-resistant garment (1).

The term "right" for the purposes of this invention means a right portion of a subject, such as a wearer, or a portion of a component of the ballistic-resistant garment (1) which would dispose proximate the right portion of the wearer when said wearer wears the ballistic-resistant garment (1).

The term "pocket" for the purposes of this invention means a receptacle configured to receive or contain one or more ballistic-resistant inserts, or other items.

The term "ballistic-resistant insert" for the purposes of this invention means a three-dimensionally shaped object, whether flat or contoured, which can have any applicable perimeter shape, whether regular or irregular, which can be capable of slowing or stopping one or more insults, such as a high velocity projectile, for example via one or more energy-absorbing mechanisms. The ballistic resistant insert can be generally rigid, semi-rigid, flexible, or combinations thereof, depending upon the application. As to particular embodiments, a ballistic-resistant insert for use with the instant invention can comply with NIJ Standard-0101.06.

Figure 1A:
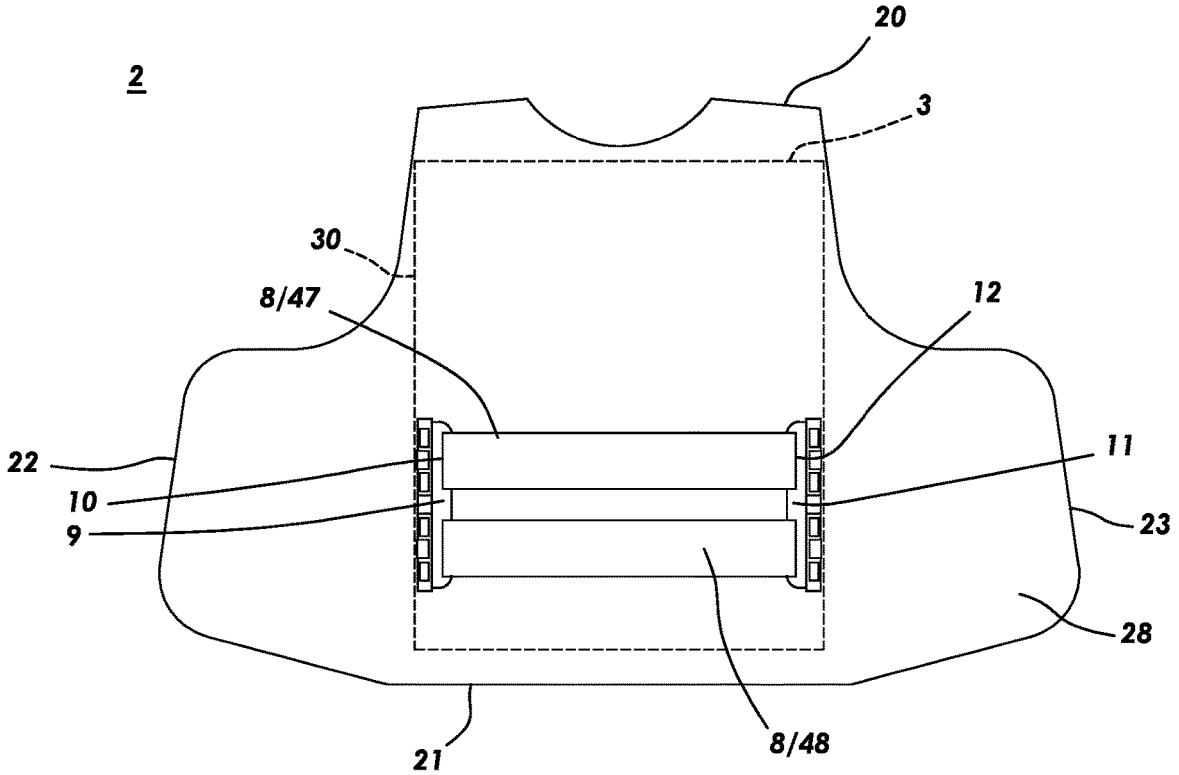
FIG. 1A is an outer view of a particular embodiment of a front panel of the inventive ballistic-resistant garment.
Figure 1B:
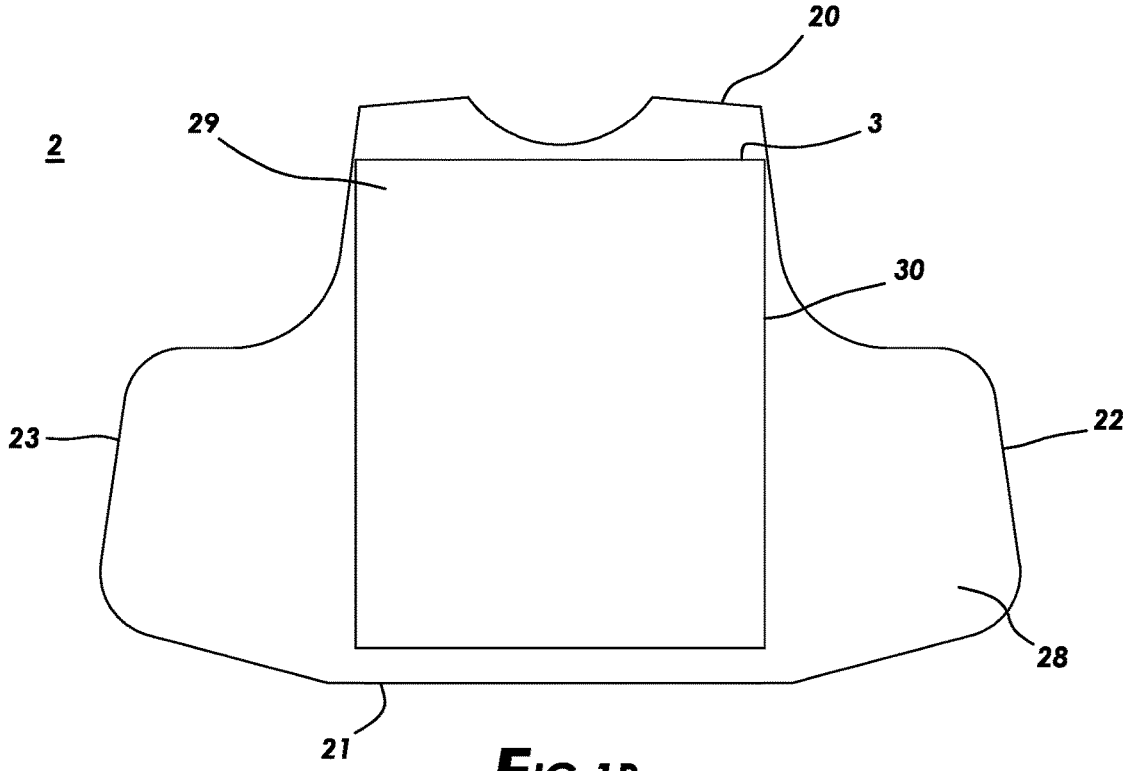
FIG. 1B is an inner view of the particular embodiment of the front panel shown in FIG. 1A.

Now referring primarily to FIGS. 1A and 1B, the ballistic-resistant garment (1) includes a front panel (2) configured to be worn about the front torso of a wearer, whereby the front panel (2) has a front panel height extending between opposing front panel upper and lower ends (20)(21) and a front panel width extending between opposing front panel right and left sides (22)(23). Each of the front panel height and width can have any of a numerous and wide variety of suitable dimensional relations provided that in combination, the dimensional relations are such that the front panel height and width sufficiently cover the front torso of a wearer, whether partially or completely.

Figure 2A:
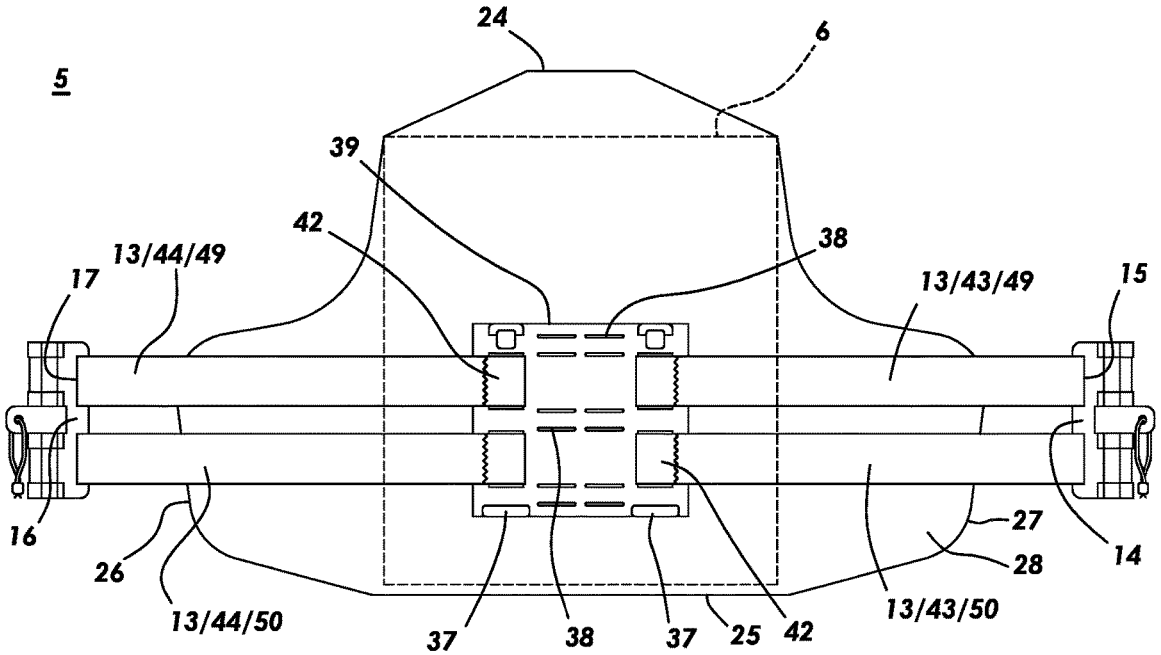
FIG. 2A is an outer view of a particular embodiment of a back panel of the inventive ballistic-resistant garment.
Figure 2B:
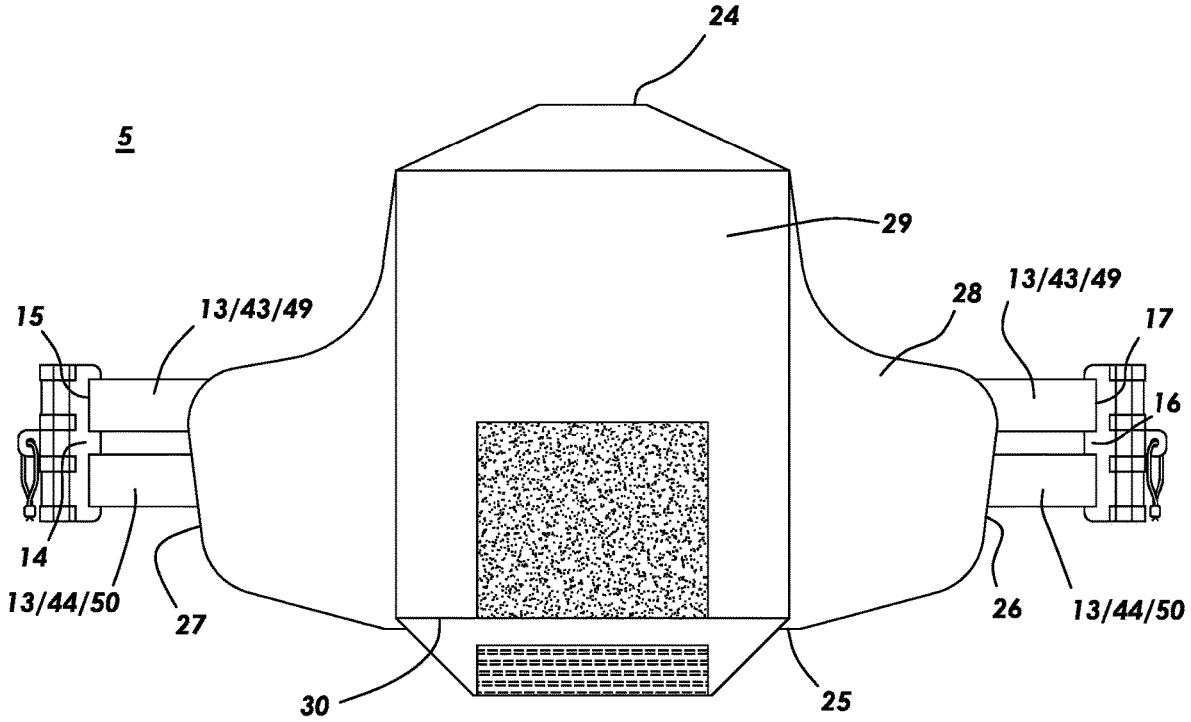
FIG. 2B is an inner view of the particular embodiment of the back panel shown in FIG. 2A.
Figure 3A:
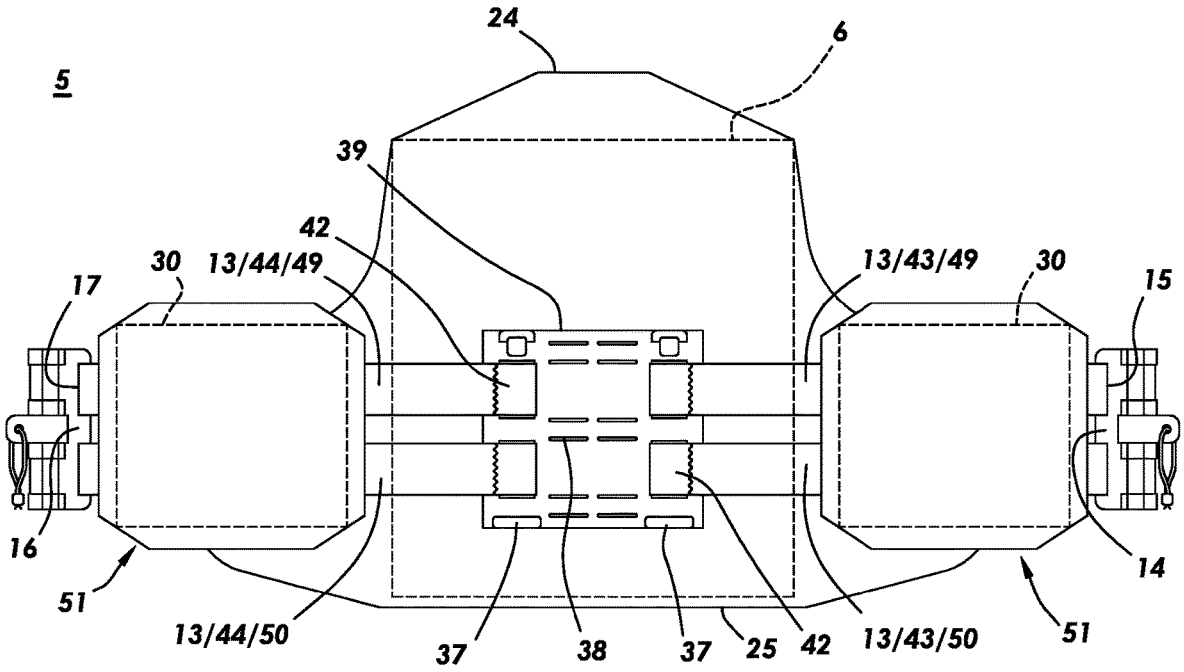
FIG. 3A is an outer view of a particular embodiment of a back panel of the inventive ballistic-resistant garment, whereby auxiliary pockets are coupled to the elongate member(s).
Figure 3B:
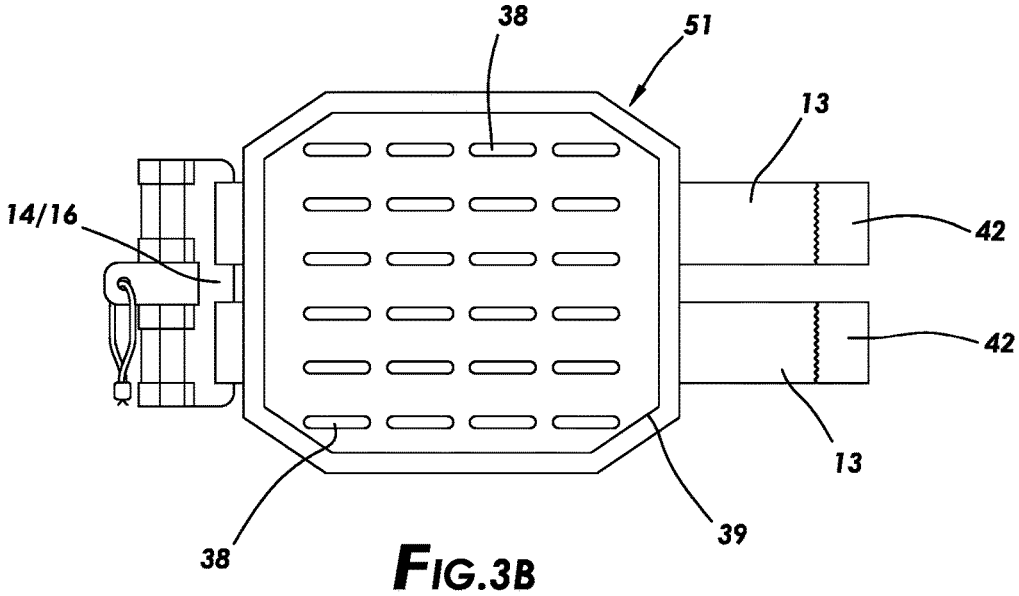
FIG. 3B is an outer view of an elongate member(s) having an auxiliary pocket coupled thereto.
Figure 3C:
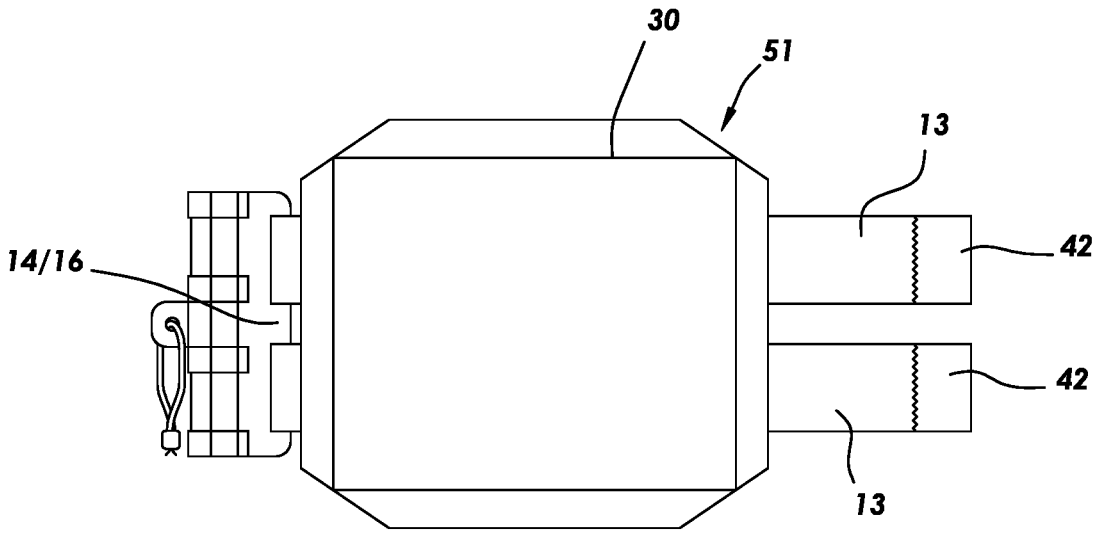
FIG. 3C is an inner view of the elongate member(s) and auxiliary pocket shown in FIG. 3B.
Figure 4A:
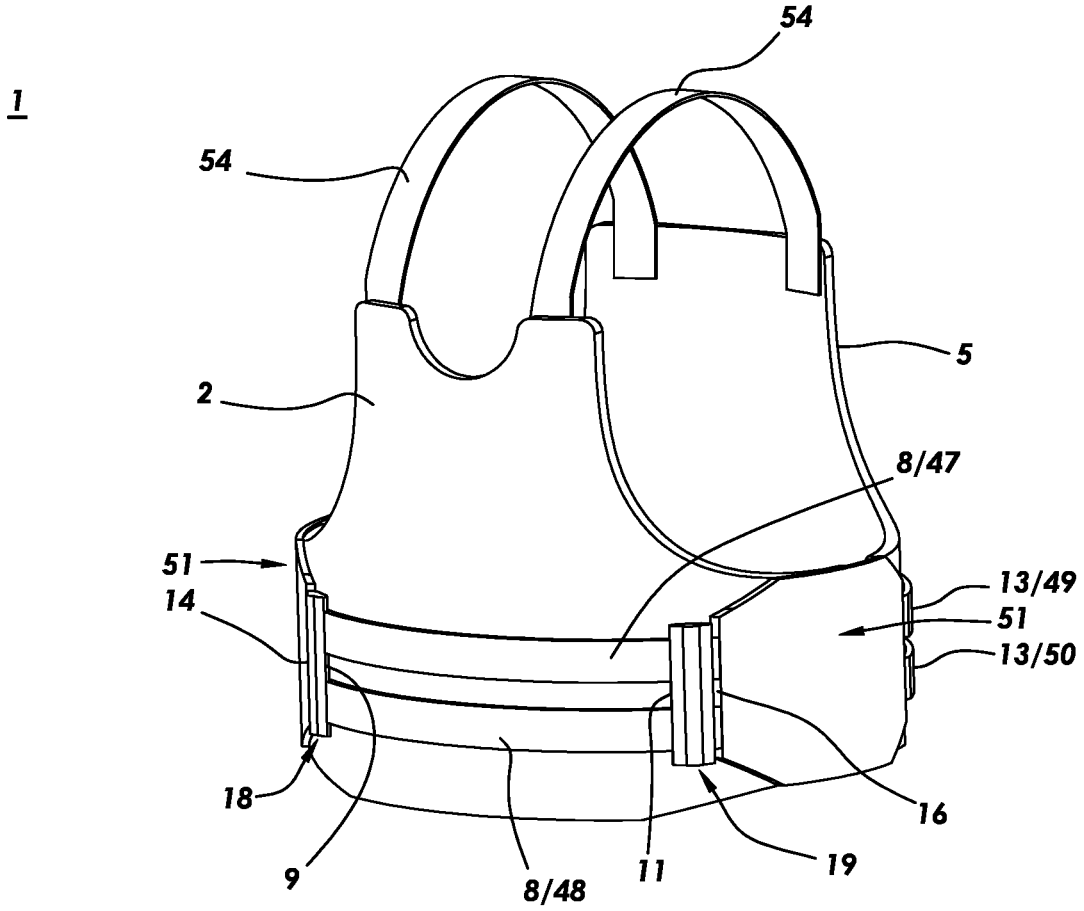
FIG. 4A is a perspective view of a particular embodiment of the inventive ballistic-resistant garment, whereby the front and back panels are coupled together.
Figure 4B:
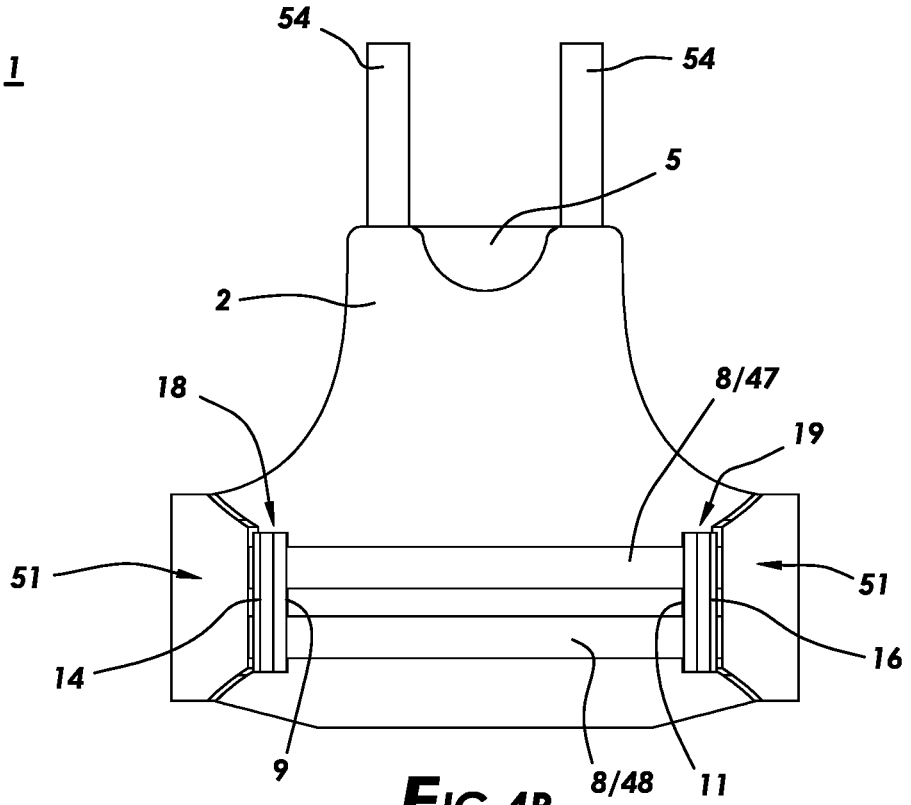
FIG. 4B is a front view of the particular embodiment of the ballistic-resistant garment shown in FIG. 4A.
Figure 4C:
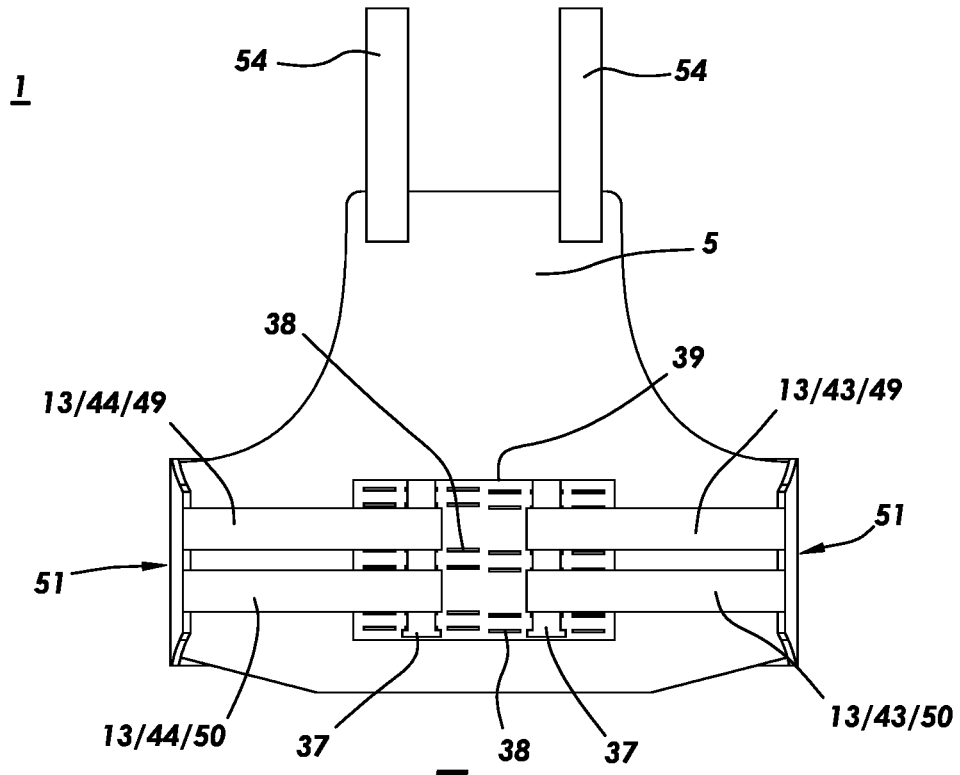
FIG. 4C is a rear view of the particular embodiment of the ballistic-resistant garment shown in FIG. 4A.
Figure 4D:
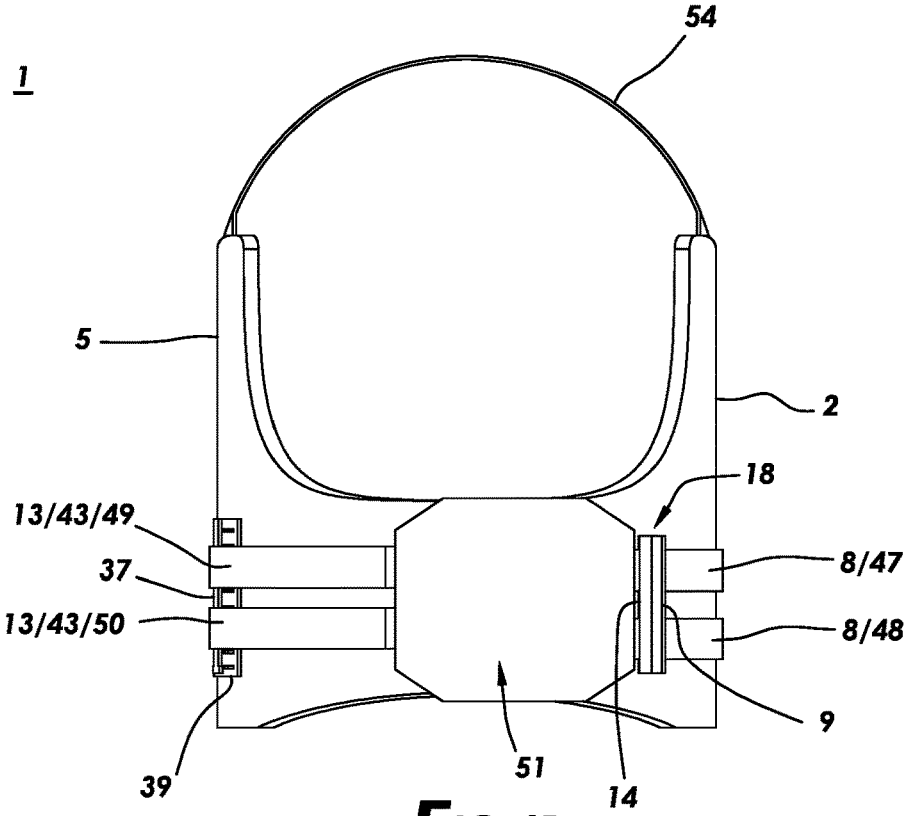
FIG. 4D is a left side view of the particular embodiment of the ballistic-resistant garment shown in FIG. 4A.
Figure 4E:
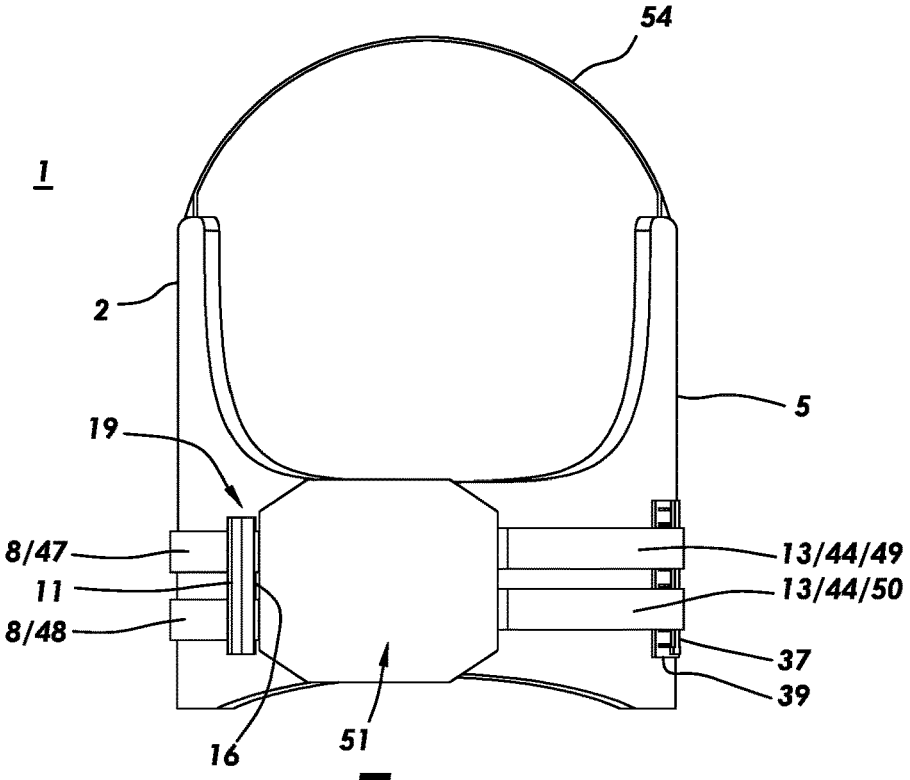
FIG. 4E is a right side view of the particular embodiment of the ballistic-resistant garment shown in FIG. 4A.
Figure 4F:
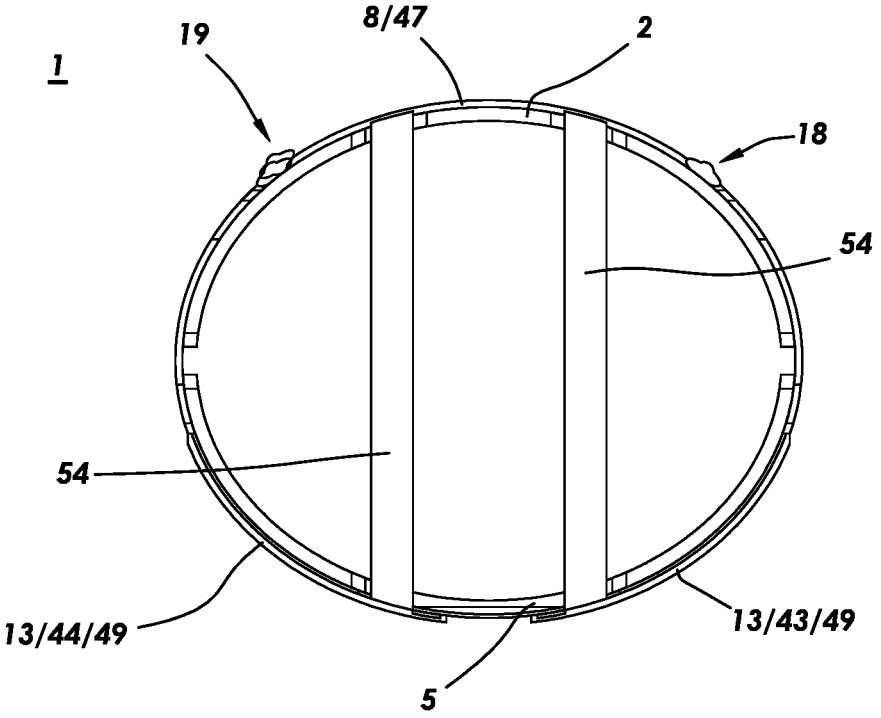
FIG. 4F is a top view of the particular embodiment of the ballistic-resistant garment shown in FIG. 4A.
Figure 4G:
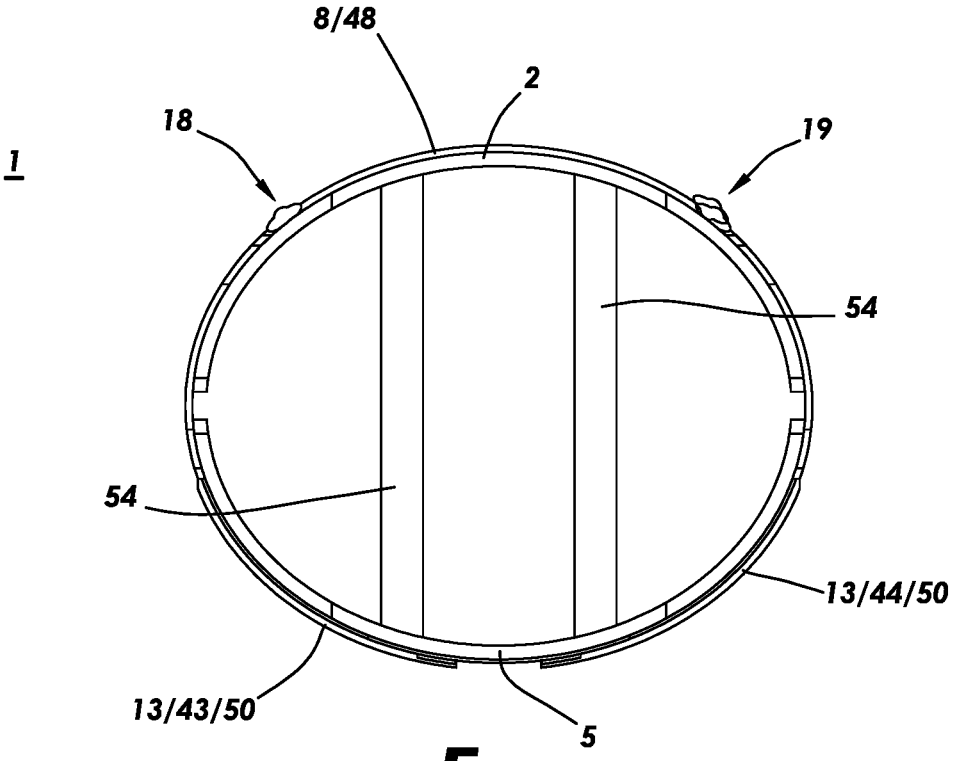
FIG. 4G is a bottom view of the particular embodiment of the ballistic-resistant garment shown in FIG. 4A.

Now referring primarily to FIGS. 2A and 2B and akin to the front panel (2), the ballistic-resistant garment (1) further includes a back panel (5) configured to be worn about the back torso of a wearer, whereby the back panel (5) has a back panel height extending between opposing back panel upper and lower ends (24)(25) and a back panel width extending between opposing back panel left and right sides (26)(27). Each of the back panel height and width can have any of a numerous and wide variety of suitable dimensional relations provided that in combination, the dimensional relations are such that the back panel height and width sufficiently cover the back torso of a wearer, whether partially or completely.

Now referring primarily to FIGS. 4A through 4G, as to particular embodiments, the front and back panels (2)(5) can together form a vest-like ballistic resistant garment (1), which can be generally sleeveless (as shown in the examples of the Figures); however, the invention need not be limited to this configuration.

Now referring primarily to FIGS. 1A through 2B, 5A, and 5B, each of the front and back panels (2)(5) includes a corresponding front or back panel pocket (3)(6) configured to receive a corresponding first or second ballistic-resistant insert (4)(7).

As to particular embodiments, each panel (2)(5) can include first and second materials (28)(29) disposed in overlaying engagement to form the pocket (3)(6) which defines a pocket interior space therebetween, whereby the pocket (3)(6) can have a pocket opening (30) through which a ballistic-resistant insert (4)(7) can be passed for receipt within the pocket interior space.

As to particular embodiments, a pocket opening (30) can dispose proximate a panel side (22)(23)(26)(27). Now referring primarily to FIG. 5A, as but one illustrative example, a front panel pocket (3) can include a pocket opening (30) disposed proximate a front panel right or left side (22)(23), whereby such a pocket opening (30) may be accessible from the outer surface of the front panel (2) to permit external loading of the first ballistic-resistant insert (4).

As to particular embodiments, a pocket opening (30) can dispose proximate a panel lower end (21)(25). Now referring primarily to FIG. 5B, as but one illustrative example, a back panel pocket (6) can include a pocket opening (30) disposed proximate a back panel lower end (25).

Figure 5A:
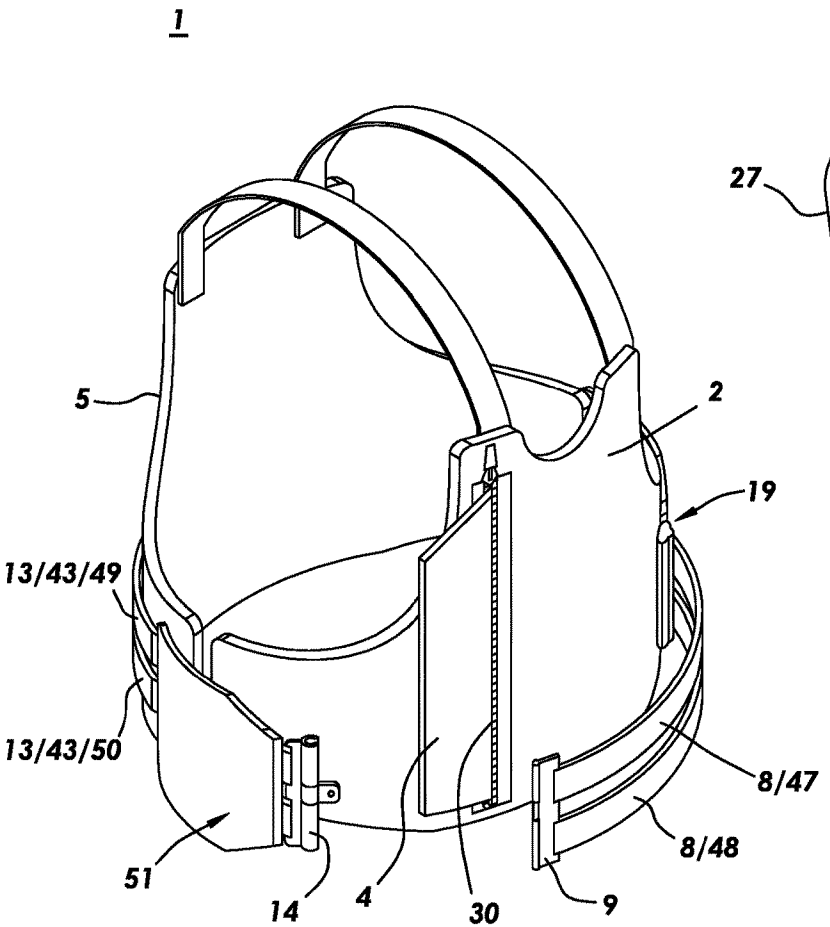
FIG. 5A is a perspective view of a particular embodiment of the inventive ballistic-resistant garment, whereby a first ballistic-resistant insert is partially received within a front panel pocket.

To secure one or more ballistic-resistant inserts (4)(7) within a pocket interior space, a securement system can be employed proximate the pocket opening (30) to close the pocket, whereby the securement system can include any of a numerous and wide variety of suitable mechanical fasteners or adhesives, depending upon the application. As but one illustrative example, the pocket opening (30) can be closed by stitches or stitching. As but a second illustrative example, the pocket opening (30) can be releasably closed by a zipper securement system (as shown in the example of FIG. 5A). As but a third illustrative example, the pocket opening (30) can be releasably closed by a hook and loop securement system (as shown in the example of FIG. 5B).

Regarding production, the first and second materials (28)(29) can be formed from any of a numerous and wide variety of suitable fabrics or fabric-like materials, whether woven or non-woven, depending upon the application. As but one illustrative example, the first material (28), which can outwardly dispose when the ballistic-resistant garment (1) is worn about the torso of a wearer, can be a flexible, durable, stain-resistant fabric, such as nylon (for example 500 denier CORDURA® nylon fabric) or polyester. The second material (29), which can inwardly dispose when the ballistic-resistant garment (1) is worn about the torso of the wearer, can also be nylon or polyester, whereby the fabric may be the same as, similar to, or different from the first material (28). As but one illustrative example of the latter, the second material (29) can be 210 denier doublewall ripstop nylon. As to particular embodiments, a breathable fabric, such as mesh or mesh-like fabric (which may also have antimicrobial properties), can inwardly dispose when the ballistic-resistant garment (1) is worn about the torso of a wearer.

As to particular embodiments, the front and back panels (2)(5) can each include an additional pocket(s), such as a secondary pocket, a tertiary pocket, etc., whether internally or externally accessible, whereby such a pocket(s) may be configured to receive or contain one or more ballistic-resistant inserts or other items, depending upon the application.

Now referring primarily to FIGS. 1A through 2B, and 4A through 4G, the ballistic-resistant garment (1) can further include (i) a front panel elongate member (8) coupled to the front panel (2), and (ii) a back panel elongate member (13) coupled to the back panel (5), whereby as used herein, the term "elongate member" may be construed as similar to or synonymous with "band" or "strip," which can mean a generally planar (or flat) piece of material having a substantially greater length than width. As to particular embodiments, an elongate member (8)(13) can be flexible and correspondingly, conformable to a wearer and in particular, an elongate member (8)(13) can conform about a portion or an entirety of the torso of a wearer.

An elongate member (8)(13) can have an elastic (or resiliently stretchable) length disposed between opposing first and second ends, whereby the length disposes along the longitudinal axis of the elongate member (8)(13). In particular, the front panel elongate member (8) can have an elastic length disposed between opposing front panel elongate member first and second ends (10)(12), and the back panel elongate member (13) can have an elastic length disposed between opposing back panel elongate member first and second ends (15)(17). As elastic, the length can be resiliently stretchable between a relaxed state and an extended state, whereby the extended state can be generated from the relaxed state by the application of a tensile force(s) that acts on the elongate member (8)(13) along its length. Regarding dimensions, the length of the front panel elongate member (8) can be sufficient to span a portion or an entirety of the front torso of a wearer, and the length of the back panel elongate member (13) can be sufficient to span a portion or an entirety of the back torso of a wearer. Of course, it is herein contemplated that various lengths of elongate members (8)(13) may be provided for differently sized wearers.

As but one illustrative example, the length of a front panel elongate member (8) can be in a range of between about 20 inches to about 40 inches.

As but one illustrative example, the length of a back panel elongate member (13) can be in a range of between about 22 inches to about 48 inches.

The width of an elongate member (8)(13) may or may not be elastic, depending upon the embodiment. Concerning dimensions, as but one illustrative example, the width of an elongate member (8)(13) can be in a range of between about 0.5 inches to about 2.5 inches. As but one illustrative example, the width of an elongate member (8)(13) can be about 1.5 inches.

As to particular embodiments, an elongate member (8)(13) can be (i) generally planar and/or (ii) generally rectangular with a substantially constant width along its length. However, an elongate member (8)(13) need not be limited to these particular configurations.

An elongate member (8)(13) can be formed from any of a numerous and wide variety of flexible, elastic materials, suitable for the intended use detailed herein. As but one illustrative example, an elongate member (8)(13) can be formed from a polyester woven elastic. As but a second illustrative example, an elongate member (8)(13) can be formed from a P-W041 Polyester Woven Elastic, available from John Howard Company, Inc., 4510 Schaefer Ave., Chino, California 91710, USA.

Again referring primarily to FIGS. 1A through 2B, and 4A through 4G, the ballistic-resistant garment (1) further includes (i) a front panel first fastener (9) coupled to the front panel elongate member first end (10), (ii) a front panel second fastener (11) coupled to the front panel elongate member second end (12), (iii) a back panel first fastener (14) coupled to the back panel elongate member first end (15), and (iv) a back panel second fastener (16) coupled to the back panel elongate member second end (17). The front panel first fastener (9) can be configured to matably engage with the back panel first fastener (14) to provide a first pair of releasably engaged fasteners (18) which couple the front and back panels (2)(5) to fasten the ballistic-resistant garment (1) about a right side portion of the torso of a wearer. Similarly, the front panel second fastener (11) can be configured to matably engage with the back panel second fastener (16) to provide a second pair of releasably engaged fasteners (19) which couple the front and back panels (2)(5) to fasten the ballistic-resistant garment (1) about a left side portion of the torso of a wearer. Following, together, the first and second pair of releasably engaged fasteners (18)(19) can couple the front and back panels (2)(5) to tensionably fasten the ballistic-resistant garment (1) about the torso of a wearer.

A fastener (9)(11)(14)(16) may be configured as any of a numerous and wide variety of suitable fasteners which can matably engage with a corresponding fastener (9)(11)(14)(16) to provide a pair of releasably engaged fasteners (18)(19).

As but one illustrative example, one fastener (14)(16) can be configured as a clip having a channel, and the corresponding fastener (9)(11) can be configured as a pin receivable in the channel. As to particular embodiments, the clip and the pin can be configured as a rapid-release or quick-release system.

Figure 10A:
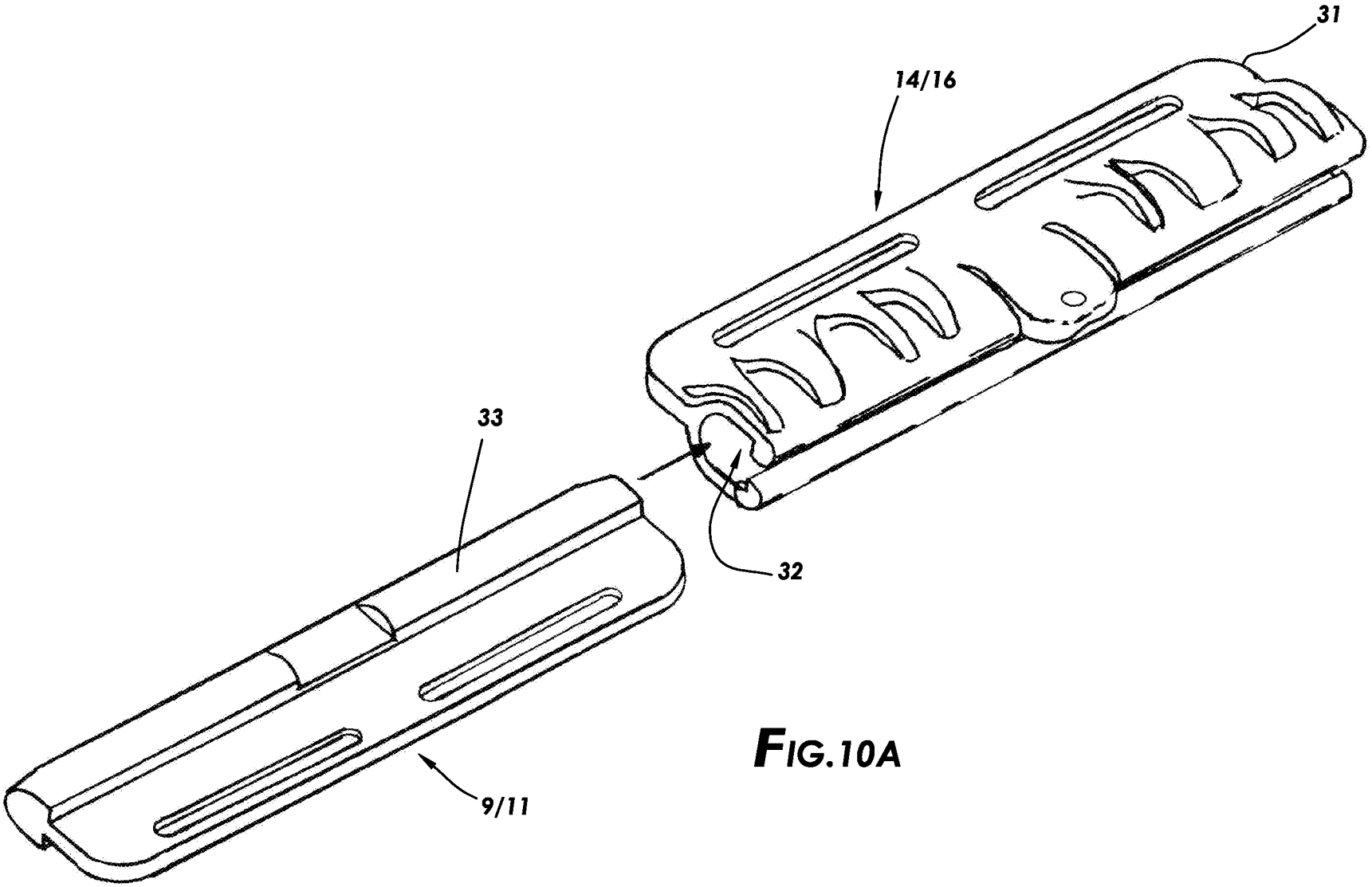
FIG. 10A is a perspective view of a particular embodiment of a fastener which may be useful with the inventive ballistic-resistant garment, whereby the fastener is shown in a disassembled state.
Figure 10B:
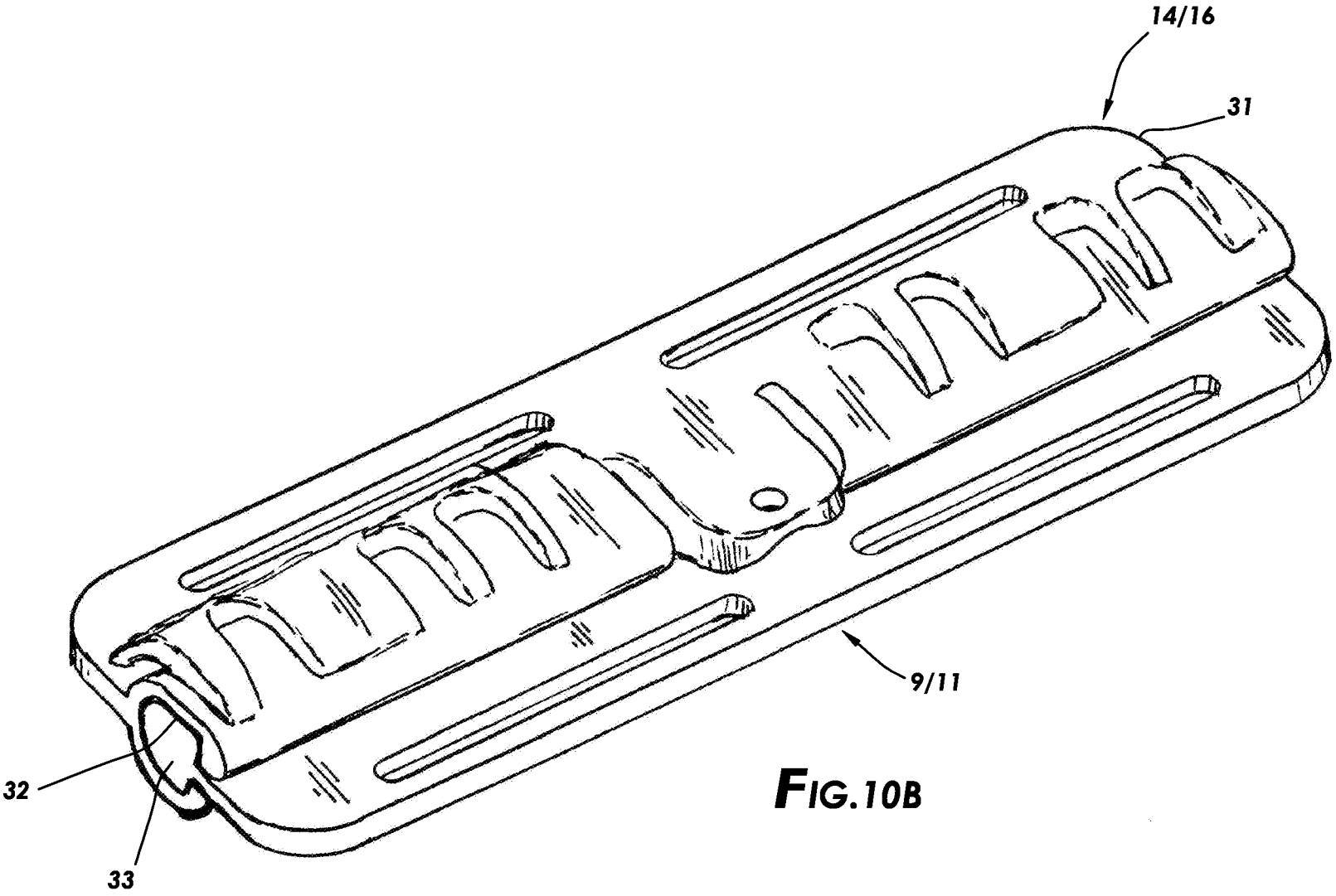
FIG. 10B is a perspective view of the particular embodiment of the fastener shown in FIG. 10A, but whereby the fastener is shown in an assembled state.

As but a second illustrative example, one fastener (14)(16) can be configured as a clip (31) having a channel (32), and the corresponding fastener (9)(11) can be configured as a pin (33) receivable in the channel (32), whereby the clip (31), channel (32), and pin (33) can be configured as disclosed in U.S. Pat. No. 10,051,984, which is hereby incorporated by reference herein in its entirety, whereby instant FIGS. 10A and 10B correspond to FIGS. 4 and 5 of this patent.

As but a third illustrative example, the fasteners (9)(11)(14)(16) can be configured as FIRSTSPEAR® TUBES™, available from FirstSpear, LLC, 2015 Corporate 44 Dr, Fenton, Missouri 63026, USA.

Figure 11:
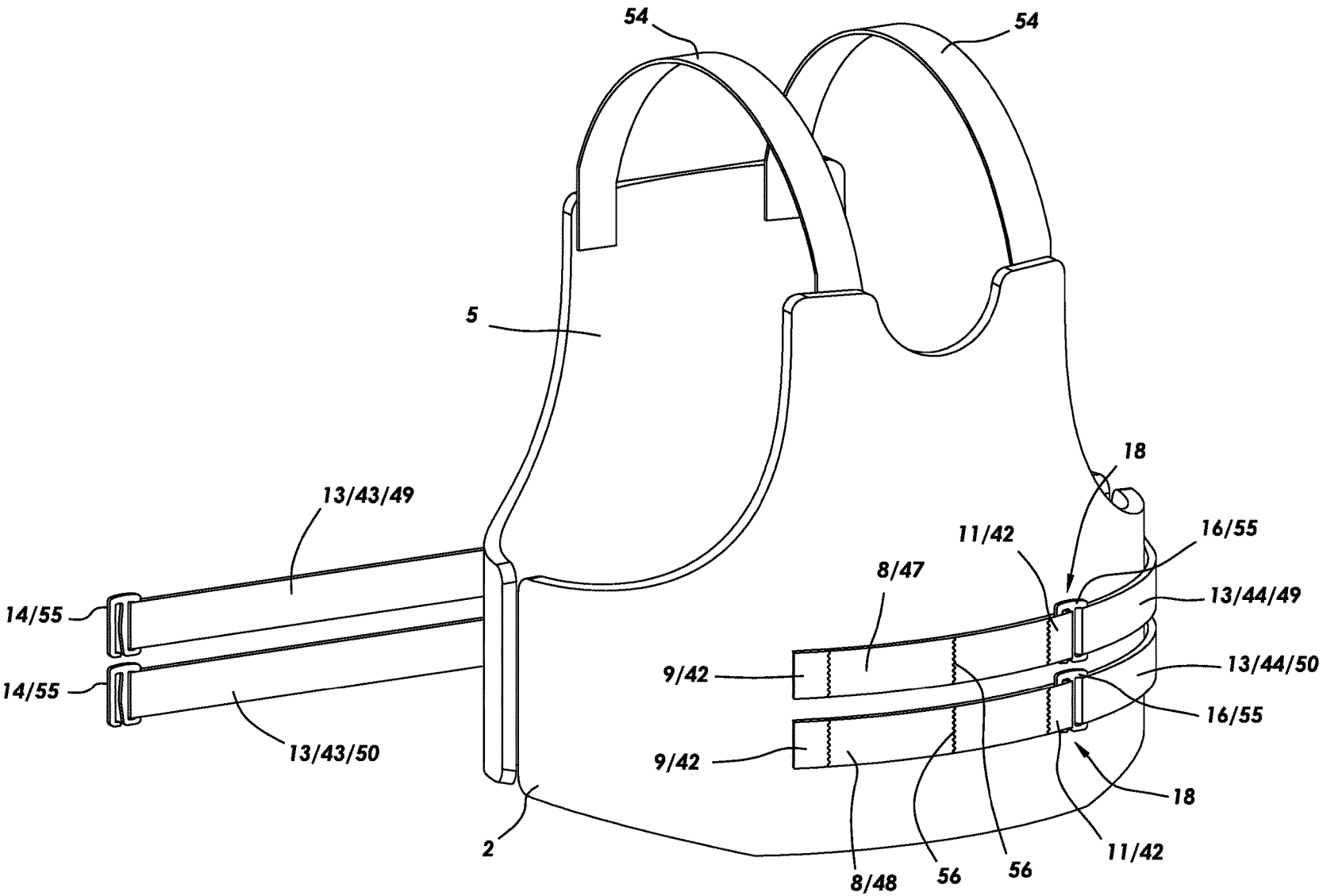
FIG. 11 is a perspective view of a particular embodiment of the inventive ballistic-resistant garment, whereby the fasteners comprise a hook and loop system.

As but a fourth illustrative example, the fasteners (9)(11)(14)(16) can be configured as a hook and loop system. In particular, one fastener (14)(16) can be configured as a hook (55), and the corresponding fastener (9)(11) can be configured as loop (42) hookable by the hook (55) (as shown in the example of FIG. 11). As to particular embodiments, the hook (55) may be configured as a G-hook.

As to particular embodiments, an elongate member (8)(13) can couple to its panel (2)(5), such as by any of a numerous and wide variety of suitable mechanical fasteners or adhesives, depending upon the application.

As to particular embodiments, an elongate member (8)(13) can be integrated with its panel (2)(5), meaning connected together so as to work together as a single complete piece or unit, and so as to be incapable of being easily dismantled without destroying the integrity of the piece or unit. As but one illustrative example, and elongate member (8)(13) can be integrated with its panel (2)(5) via stitches or stitching (56) (as shown for the front panel elongate member (s) (8) in the examples of FIGS. 9 and 11).

As to particular embodiments, an elongate member (8)(13) can removably couple to its panel (2)(5).

Figure 9:
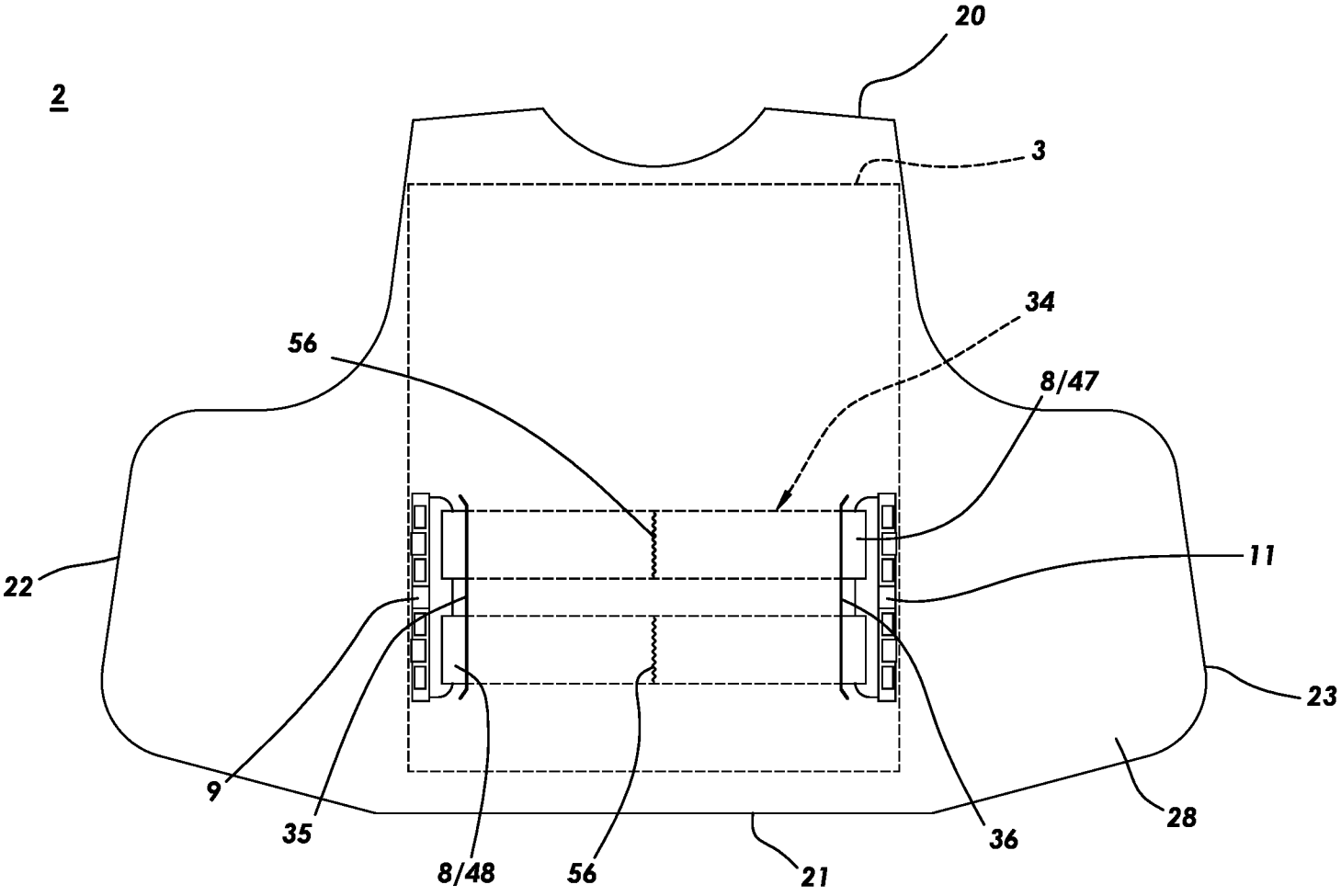
FIG. 9 is an outer view of a particular embodiment of a front panel of the inventive ballistic-resistant garment.

As one illustrative example, an elongate member (8)(13) can couple and/or removably couple to its panel (2)(5) via a passageway (34) (or pass-through) which extends between a passageway first opening (35) proximate a panel side (22)(23)(26)(27) and a passageway second opening (36) proximate the opposing panel side (22)(23)(26)(27), whereby an elongate member (8)(13) can be passed through the openings (35)(36) for (i) receipt within a passageway interior space and (ii) laterally outward extension from the openings (35)(36). As to particular embodiments, the front panel (2) of the ballistic-resistant garment (1) can include such a coupling configuration (as shown in the example of FIG. 9).

As a second illustrative example, an elongate member (8)(13) can couple to its panel (2)(5) via a connector (37), whereby the connector (37) can be configured to couple to the panel (2)(5). As to particular embodiments, the connector (37) can be configured to removably couple to the panel (2)(5). As to particular embodiments, the connector (37) can be configured for slidable engagement with a slit (38) disposed within or coupled to the panel (2)(5). As but one illustrative example, the panel (2)(5) can include a webbing (39) having a plurality of slits (38). As to particular embodiments, a plurality of slits (38) can be disposed in generally horizontal spaced-apart relation in the webbing (39) along the webbing's width, and a plurality of slits (38) can be disposed in generally vertical spaced-apart relation in the webbing (39) along the webbing's height. As to particular embodiments, a plurality of slits (38) can be aligned in generally horizontal spaced-apart relation in the webbing (39) along the webbing's width, and a plurality of slits (38) can be aligned in generally vertical spaced-apart relation in the webbing (39) along the webbing's height. As to particular embodiments, the webbing (39) can be similar to or the same as Pouch Attachment Ladder System (PALS) webbing.

The webbing (39) can be formed from any of a numerous and wide variety of suitable materials; as but one illustrative example, the webbing (39) can be formed from laminate nylon, such as 1000 denier/500 denier laminate nylon.

As to particular embodiments, the webbing (39) can be laser cut to provide the slits (38).

Figure 6A:
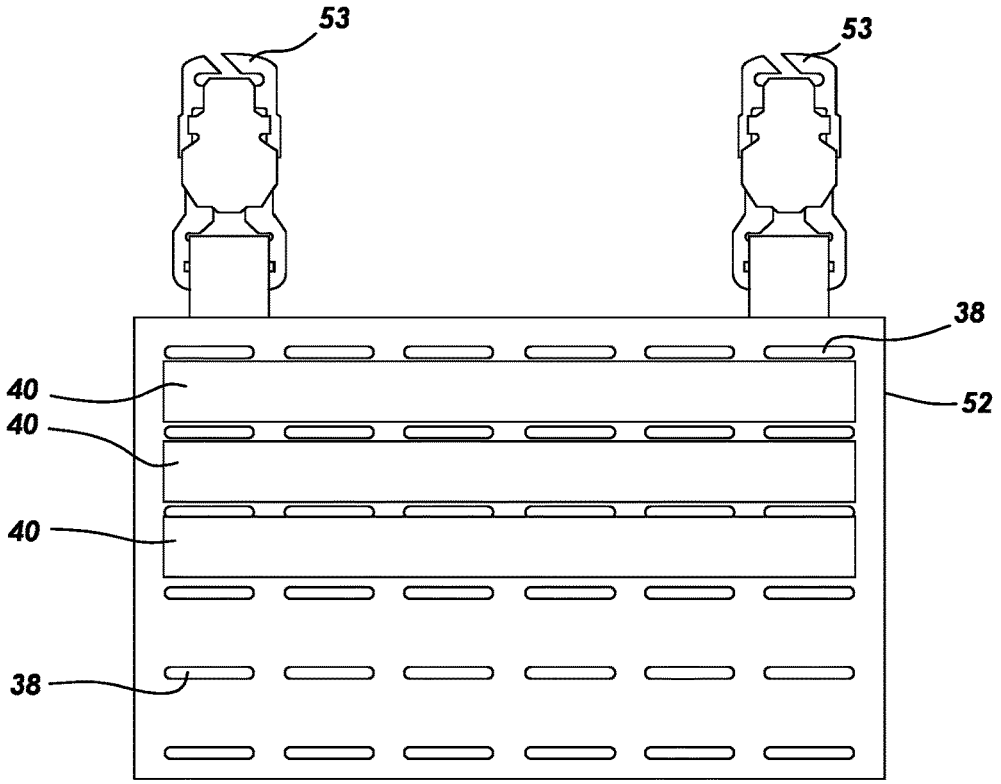
FIG. 6A is an outer view of a particular embodiment of an auxiliary webbing which can be removably coupled to the inventive ballistic-resistant garment.

As to particular embodiments, the webbing (39) can be reinforced between the slits (38), for example via a generally horizontal strip (40) secured to the webbing (39) in between rows of slits (38) (as shown in the example of FIG. 6A) or via a generally vertical strip secured to the webbing (39) in between columns of slits (38) (not shown). As to particular embodiments, the strip (40) can comprise a hook element or a loop element of a hook and loop securement system.

Figure 7A:
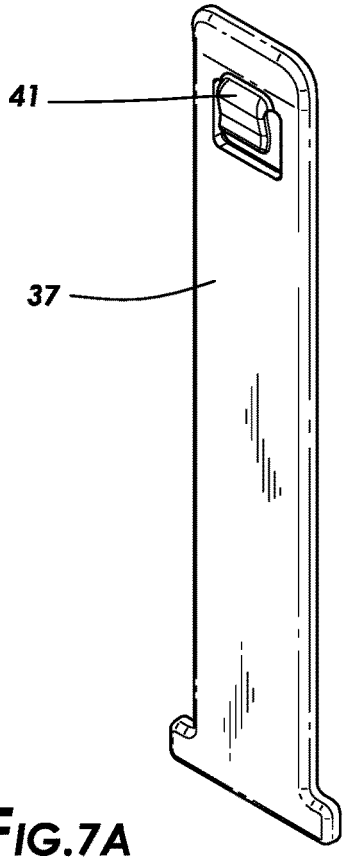
FIG. 7A is a front perspective view of a particular embodiment of a connector which may be useful with the inventive ballistic-resistant garment.
Figure 7B:
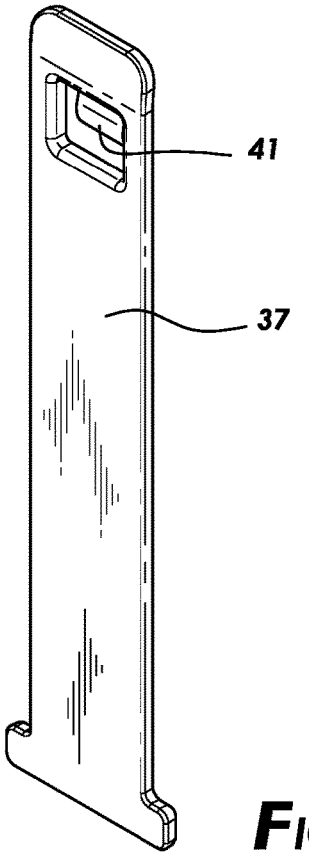
FIG. 7B is a rear perspective view of the particular embodiment of the connector shown in FIG. 7A.
Figure 8:
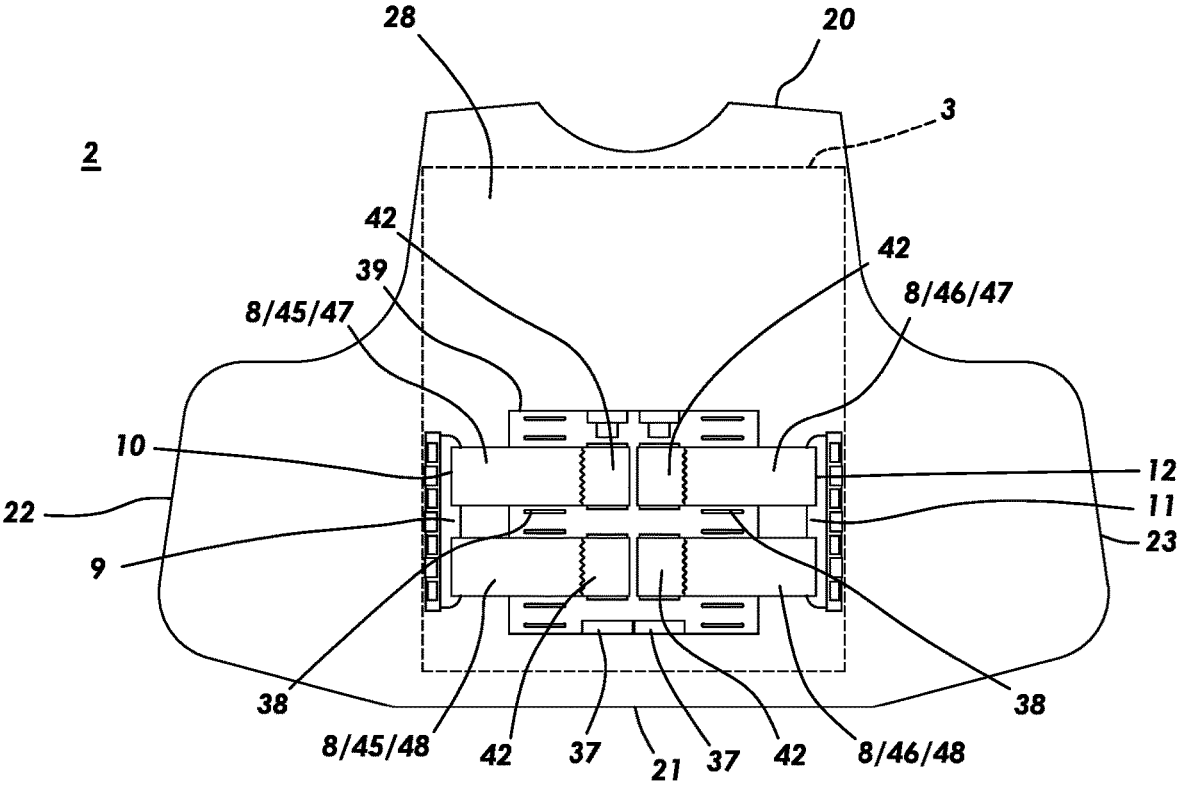
FIG. 8 is an outer view of a particular embodiment of a front panel of the inventive ballistic-resistant garment.

Now referring primarily to FIGS. 7A and 7B, as to particular embodiments, the connector (37) can be configured as an elongate connector which can be woven through (or slidably engaged with) a plurality of vertically-aligned slits (38) (or a column of slits (38)) disposed in the webbing (39).

Again referring primarily to FIGS. 7A and 7B, as to particular embodiments, the elongate connector (37) can be configured to have at least one clip (41), clip-like element, hook, hook-like element, or the like, proximate its end, whereby the clip (41) can function as a stop element, thereby stopping that end of the elongate connector (37) from passing completely through the slits (38).

As to particular embodiments, the elongate connector (37) can be similar to or the same as a Modular Lightweight Load-carrying Equipment (MOLLE) component.

Regarding coupling, an elongate member (8)(13) can include a loop (42), whereby the connector (37) can be woven through (or slidably engaged with) a plurality of vertically-aligned slits (38) and the loop (42) to couple the elongate member (8)(13) to the webbing (39) via the connector (37).

As to particular embodiments, an elongate member (8)(13) can be a single or one-piece or monolithic or integrated construct, meaning seamlessly continuous between its first and second ends (10)(12)(15)(17) (as shown in the example of FIG. 1A).

As to other particular embodiments, an elongate member (8)(13) can comprise a pair of elongate members, each having a fastener (9)(11)(14)(16) proximate one end and a loop (42) proximate the opposing end. Accordingly, each of the pair the of elongate members can be coupled to the webbing (39) via its loop (42) and a connector (37) to dispose the elongate members in horizontally spaced-apart and horizontally aligned relation.

Now referring primarily to FIGS. 1A through 2B, and 4A through 4G, as to particular embodiments, the front panel elongate member (8) can be seamlessly continuous between its first and second ends (10)(12), and the back panel elongate member (8) can include a pair of elongate members, such as a back panel right elongate member (43) and a back panel left elongate member (44), coupled to the back panel (5) in horizontally spaced-apart and horizontally aligned relation. Following, the front panel first fastener (9) can matably engage with the back panel first fastener (14) coupled to the back panel right elongate member (43) to provide the first pair of releasably engaged fasteners (18) which couple the front and back panels (2)(5) to fasten the ballistic-resistant garment (1) about a right side portion of the torso of a wearer, and the front panel second fastener (11) can matably engage with the back panel second fastener (16) coupled to the back panel left elongate member (44) to provide the second pair of releasably engaged fasteners (19) which couple the front and back panels (2)(5) to fasten the ballistic-resistant garment (1) about a left side portion of the torso of a wearer, whereby together, the first and second pair of releasably engaged fasteners (18)(19) tensionably fasten the ballistic-resistant garment (1) about the torso of a wearer.

Now referring primarily to FIGS. 2A, 2B, and 9, as to particular embodiments, the front panel elongate member (8) can include a pair of elongate members, such as a front panel right elongate member (45) and a front panel left elongate member (46), coupled to the front panel (2) in horizontally-aligned relation, and the back panel elongate member (8) can include a pair of elongate members, such as a back panel right elongate member (43) and a back panel left elongate member (44), coupled to the back panel (5) in horizontally-aligned relation. Following, the front panel first fastener (9) coupled to the front panel right elongate member (45) can matably engage with the back panel first fastener (14) coupled to the back panel right elongate member (43) to provide the first pair of releasably engaged fasteners (18) which couple the front and back panels (2)(5) to fasten the ballistic-resistant garment (1) about a right side portion of the torso of a wearer, and the front panel second fastener (11) coupled to the front panel left elongate member (46) can matably engage with the back panel second fastener (16) coupled to the back panel left elongate member (44) to provide the second pair of releasably engaged fasteners (19) which couple the front and back panels (2)(5) to fasten the ballistic-resistant garment (1) about a left side portion of the torso of a wearer, whereby the first and second pair of releasably engaged fasteners (18)(19) tensionably fasten the ballistic-resistant garment (1) about the torso of a wearer.

Now referring primarily to FIGS. 1A through 2B, 4A through 4G, and 9, as to particular embodiments, the front panel (2) can include a pair of elongate members, such as a front panel upper elongate member (47) and a front panel lower elongate member (48) disposed in vertically spaced-apart and vertically aligned relation, whereby (i) the first ends of both (47)(48) couple to the front panel first fastener (9) and (ii) the second ends of both (47)(48) couple to the front panel second fastener (11). Likewise, the back panel (5) can include a pair of elongate members, such as a back panel upper elongate member (49) and a back panel lower elongate member (50) disposed in vertically spaced-apart and vertically aligned relation, whereby (i) the first ends of both (49)(50) couple to the back panel first fastener (14) and (ii) the second ends of both (49)(50) couple to the back panel second fastener (16).

As to particular embodiments, an elongate member (8)(13) can be adjustably coupled, such as incrementally adjustably coupled, to its panel (2)(5)/webbing (39) such that the elongate member (8)(13) and in particular its associated connector (37) can be adjustably positioned along the width of the panel (2)(5)/webbing (39), whereby the adjustment can be facilitated by the selection of the column of slits (38) to which the loop (42) of the elongate member (8)(13) and its associated connector (37) are coupled. Regarding the adjustability of the fit facilitated by an elongate member (8)(13) comprising a pair of elongate members disposed a distance apart along the width of the panel (2)(5)/webbing (39) in horizontally-aligned relation, coupling the pair of elongate members to the panel (2)(5)/webbing (39) via their associated connectors (37) a lesser distance apart may be useful for customizing the fit of the ballistic-resistant garment (1) for a wearer with lesser torso dimensional relations, such as a lesser distance encircling the torso, versus a wearer with greater torso dimensional relations. Conversely, coupling the pair of elongate members to the panel (2)(5)/webbing (39) via their associated connectors (37) a greater distance apart may be useful for customizing the fit of the ballistic-resistant garment (1) for a wearer with greater torso dimensional relations, such as a greater distance encircling the torso, versus a wearer with lesser torso dimensional relations. Of course, the elastic (or resiliently stretchable) length of the elongate members (8)(13) also contributes to the customization of the tensioned fit of the ballistic-resistant garment (1) for a wearer.

As to particular embodiments, an elongate member (8)(13) can be adjustably coupled, such as incrementally adjustably coupled, to its panel (2)(5)/webbing (39) such that the elongate member (8)(13) and in particular its associated connector (37) can be adjustably positioned along the height of the panel (2)(5)/webbing (39), whereby the adjustment can be facilitated by the selection of the row of slits (38) to which the loop (42) of the elongate member (8)(13) and its associated connector (37) are coupled.

As to particular embodiments, an elongate member (8)(13) can further include an auxiliary pocket (51) coupled thereto, whereby the auxiliary pocket (51) can be configured to (i) receive a ballistic-resistant insert and (ii) when the ballistic-resistant garment (1) is worn about the torso of a wearer, dispose proximate a side portion of the torso of the wearer to additionally provide protection to said side portion.

Now referring primarily to FIGS. 3A through 4G, as an illustrative example, a back panel right elongate member (43) can include a first auxiliary pocket (51) coupled thereto (such as proximate the back panel first fastener (14)), and a back panel left elongate member (44) can include a second auxiliary pocket (51) coupled thereto (such as proximate the back panel second fastener (16)), whereby, when the ballistic-resistant garment (1) is worn about the torso of a wearer, the first auxiliary pocket (51) can dispose proximate a right side portion of the torso of the wearer and the second auxiliary pocket (51) can dispose proximate a left side portion of the torso of the wearer.

As to particular embodiments, an auxiliary pocket (51) can include a webbing (39) coupled to its outer surface, whereby the webbing (39) may be useful for coupling additional components to the ballistic-resistant garment (1) via a connector (37).

Figure 6B:
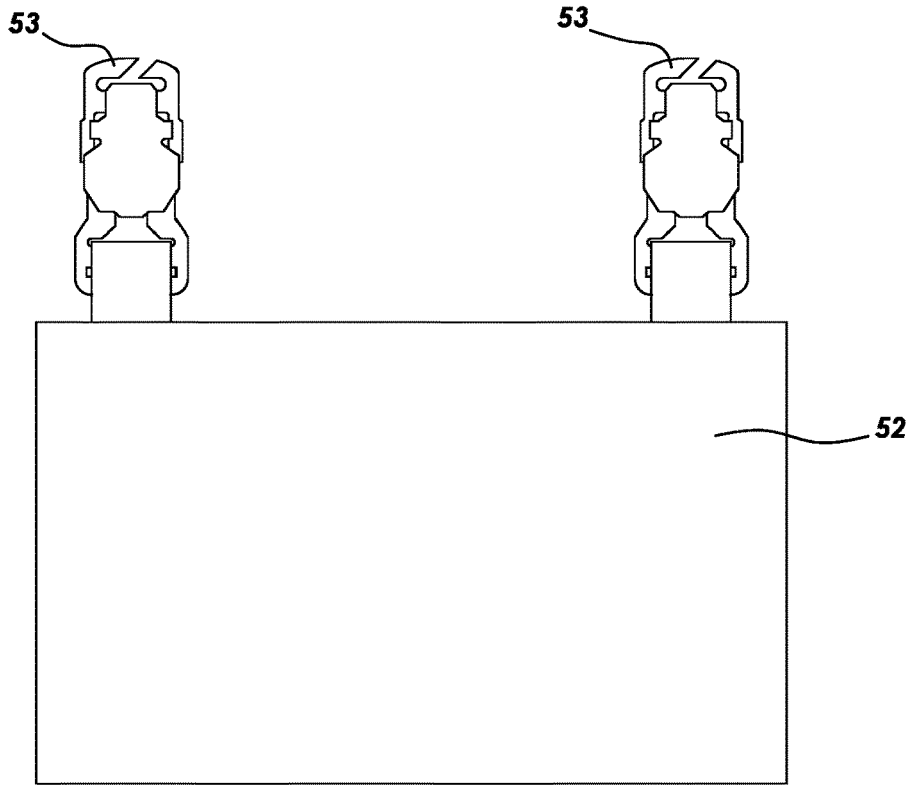
FIG. 6B is an inner view of the particular embodiment of the auxiliary webbing shown in FIG. 6A.

As to particular embodiments, the ballistic-resistant garment (1) can further include an auxiliary webbing (52) configured for removable coupling to a panel (2)(5). Now referring primarily to FIGS. 6A and 6B, as to particular embodiments, an auxiliary webbing (52) can be configured for removable coupling to the front panel (2), for example via a clip(s) (53) configured to engage with webbing (39) of the front panel (2).

Now referring primarily to FIGS. 4A through 4G, as to particular embodiments, the ballistic-resistant garment (1) can further include a pair of strap elements (54) which couple the front and back panels (2)(5) together proximate the corresponding front and back panel upper ends (20)(24).

As to particular embodiments, the strap elements (54) can releasably couple the front and back panels (2)(5) together proximate the corresponding front and back panel upper ends (20)(24), whereby the releasable coupling can be facilitated by a releasable connector system.

A method of making the ballistic-resistant garment (1) having a tensioning fastening system can include (i) providing a front panel (2) having a front panel pocket (3) configured to receive a first ballistic-resistant insert (4); (ii) providing a back panel (5) having a back panel pocket (6) configured to receive a second ballistic-resistant insert (7); (iii) coupling a front panel elongate member (8) to the front panel (2), the front panel elongate member (8) having an elastic length disposed between opposing first and second ends (10)(12); (iv) coupling a front panel first fastener (9) to the front panel elongate member first end (10); (v) coupling a front panel second fastener (11) to the front panel elongate member second end (12); (vi) coupling a back panel elongate member (13) to the back panel (5), the back panel elongate member (13) having an elastic length disposed between opposing first and second ends (15)(17); (vii) coupling a back panel first fastener (14) to the back panel elongate member first end (15); and (viii) coupling a back panel second fastener (16) to the back panel elongate member second end (17). In use, the front panel first fastener (9) can matably engage with the back panel first fastener (14) to provide a first pair of releasably engaged fasteners (18), and the front panel second fastener (11) can matably engage with the back panel second fastener (16) to provide a second pair of releasably engaged fasteners (19); whereby the first and second pair of releasably engaged fasteners (18)(19) couple the front and back panels (2)(5) to tensionably fasten the ballistic-resistant garment (1) about the torso of a wearer.

The method of making the ballistic-resistant garment (1) having a tensioning fastening system can further include providing additional components of the ballistic-resistant garment (1) as described above.

As can be easily understood from the foregoing, the basic concepts of the present invention may be embodied in a variety of ways. The invention involves numerous and varied embodiments of a ballistic-resistant garment and methods for making and using such a ballistic-resistant garment, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "fastener" and even a "means for fastening". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a wearer of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the ballistic-resistant garments herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A ballistic-resistant garment having a tensioning fastening system, comprising:

a front panel having a front panel pocket configured to receive a first ballistic-resistant insert;

a back panel having a back panel pocket configured to receive a second ballistic-resistant insert;

a front panel elongate member coupled to said front panel, said front panel elongate member having an elastic length disposed between opposing first and second ends;

a front panel first fastener coupled to said front panel elongate member first end;

a front panel second fastener coupled to said front panel elongate member second end;

a back panel elongate member coupled to said back panel, said back panel elongate member having an elastic length disposed between opposing first and second ends;

a back panel first fastener coupled to said back panel elongate member first end;

a back panel second fastener coupled to said back panel elongate member second end;

said front panel first fastener configured to matably engage with said back panel first fastener to provide a first pair of releasably engaged fasteners, and said front panel second fastener configured to matably engage with said back panel second fastener to provide a second pair of releasably engaged fasteners;

said front panel first fastener configured as a clip having a channel, said back panel first fastener configured as a pin receivable in said channel;

said clip and said pin configured as a rapid-release or quick-release system;

wherein said first and second pair of releasably engaged fasteners couple said front and back panels to tensionably fasten said ballistic-resistant garment about a torso of a wearer.

2. The ballistic-resistant garment of claim 1, wherein said tensioning fastening system provides 360° of tension for a customized fit about said torso of said wearer.

3. The ballistic-resistant garment of claim 1, wherein said front panel comprises first and second materials disposed in overlaying engagement to form said front panel pocket, said first and second materials defining a pocket interior space therebetween; and wherein said front panel pocket comprises a pocket opening, said first ballistic-resistant insert is configured to be passable through said pocket opening for receipt within said pocket interior space.

4. The ballistic-resistant garment of claim 3, said pocket opening disposed proximate a front panel side of said front panel.

5. The ballistic-resistant garment of claim 4, said pocket opening accessible from an outer surface of said front panel to permit external loading of said first ballistic-resistant insert.

6. The ballistic-resistant garment of claim 3, further comprising a securement system proximate said pocket opening, said securement system configured to releasably close said front panel pocket.

7. The ballistic-resistant garment of claim 1, said front panel elongate member is configured to be removably coupled to said front panel.

8. The ballistic-resistant garment of claim 7, said front panel elongate member removably coupled to said front panel via one passageway which extends between a passageway first opening proximate a front panel side and a passageway second opening proximate the opposing front panel side, said front panel elongate member passable through said openings for (i) receipt within a passageway interior space and (ii) laterally outward extension from said passageway first opening and said passageway second opening.

9. The ballistic-resistant garment of claim 1, said front panel elongate member is configured to be seamlessly continuous between said front panel elongate member first and second ends.

10. The ballistic-resistant garment of claim 1, said back panel elongate member coupled to said back panel via a connector which removably couples to said back panel.

11. The ballistic-resistant garment of claim 10, said connector configured for slidable engagement with a slit coupled to said back panel.

12. The ballistic-resistant garment of claim 11, said back panel comprising a webbing having a plurality of said slits.

13. The ballistic-resistant garment of claim 12, said back panel elongate member incrementally adjustably couplable to said webbing along a width of said webbing.

14. The ballistic-resistant garment of claim 1, said back panel elongate member further comprising an auxiliary pocket coupled thereto.

15. The ballistic-resistant garment of claim 14, said auxiliary pocket configured to receive an auxiliary ballistic-resistant insert.

16. The ballistic-resistant garment of claim 15, wherein when said ballistic-resistant garment is worn about said torso of said wearer, said auxiliary ballistic-resistant insert disposes proximate a side portion of said torso of said wearer.

17. A ballistic-resistant garment having a tensioning fastening system, comprising:

a front panel having a front panel pocket configured to receive a first ballistic-resistant insert;

a back panel having a back panel pocket configured to receive a second ballistic-resistant insert;

a front panel elongate member coupled to said front panel, said front panel elongate member having an elastic length disposed between opposing first and second ends;

a front panel first fastener coupled to said front panel elongate member first end;

a front panel second fastener coupled to said front panel elongate member second end;

a back panel elongate member coupled to said back panel, said back panel elongate member having an elastic length disposed between opposing first and second ends;

a back panel first fastener coupled to said back panel elongate member first end;

a back panel second fastener coupled to said back panel elongate member second end;

said front panel first fastener configured to matably engage with said back panel first fastener to provide a first pair of releasably engaged fasteners, and said front panel second fastener configured to matably engage with said back panel second fastener to provide a second pair of releasably engaged fasteners;

said front panel second fastener configured as a clip having a channel, said back panel second fastener configured as a pin receivable in said channel;

said clip and said pin configured as a rapid-release or quick-release system;

wherein said first and second pair of releasably engaged fasteners couple said front and back panels to tensionably fasten said ballistic-resistant garment about a torso of a wearer.

18. A ballistic-resistant garment having a tensioning fastening system, comprising:

a front panel having a front panel pocket configured to receive a first ballistic-resistant insert;

a back panel having a back panel pocket configured to receive a second ballistic-resistant insert;

a front panel elongate member coupled to said front panel, said front panel elongate member having an elastic length disposed between opposing first and second ends;

a front panel first fastener coupled to said front panel elongate member first end;

a front panel second fastener coupled to said front panel elongate member second end;

a back panel elongate member coupled to said back panel, said back panel elongate member having an elastic length disposed between opposing first and second ends;

a back panel first fastener coupled to said back panel elongate member first end;

a back panel second fastener coupled to said back panel elongate member second end;

said front panel first fastener configured to matably engage with said back panel first fastener to provide a first pair of releasably engaged fasteners, and said front panel second fastener configured to matably engage with said back panel second fastener to provide a second pair of releasably engaged fasteners;

said front panel first fastener and said back panel first fastener configured as a hook and loop system consisting of one hook and one corresponding loop hookable by said hook; and said front panel second fastener and said back panel second fastener configured as a hook and loop system consisting of one hook and one corresponding loop hookable by said hook;

wherein said first and second pair of releasably engaged fasteners couple said front and back panels to tensionably fasten said ballistic-resistant garment about a torso of a wearer.

* * * * *